United States Patent [19]

Tanaka et al.

[11] Patent Number: 4,707,856

[45] Date of Patent: Nov. 17, 1987

[54] AM STEREO RECEIVER

[75] Inventors: Kanji Tanaka, Ota; Masashi Arai, Ora, both of Japan

[73] Assignees: Sanyo Electric Co., Ltd., Osaka; Tokyo Sanyo Electric Co., Ltd., Gunma, both of Japan

[21] Appl. No.: 828,855

[22] Filed: Feb. 12, 1986

[30] Foreign Application Priority Data

| | | | |
|---|---|---|---|
| Feb. 12, 1985 | [JP] | Japan | 60-24791 |
| Feb. 12, 1985 | [JP] | Japan | 60-24792 |
| Jun. 18, 1985 | [JP] | Japan | 60-132162 |
| Jun. 19, 1985 | [JP] | Japan | 60-133395 |

[51] Int. Cl.[4] ..... H04H 5/00

[52] U.S. Cl. ..... 381/15; 324/78 D; 324/79 D

[58] Field of Search ..... 324/78 R, 78 D, 79 D; 329/112, 123, 120, 146; 381/15, 16

[56] References Cited

U.S. PATENT DOCUMENTS 4,344,038 8/1982 Streeter ..... 381/15

4,426,728 1/1984 Kahn ..... 381/15

*Primary Examiner*—Forester W. Isen

*Attorney, Agent, or Firm*—Darby & Darby

[57] ABSTRACT

An AM stereo receiver applicable to receive AM signals containing ID signals which represent different AM stereo systems. The AM stereo receiver includes an IF circuit for generating an IF signal based on a received signal, a PLL circuit for locking the frequency of the IF signal, a clock circuit for generating a clock signal based on a signal obtained from the PLL circuit, and ID signal detector for detecting any one of the ID signals and for producing a detected ID signal. A circuit for distinguishing which one of the different AM stereo systems does the detected ID signal represent includes a pulse generator for generating a first pulse signal having a pulse width as a function of the frequency of the detected ID signal, a counter for counting the number of the clock pulses occurring during said first pulse signal, and distinguish circuit for distinguishing each detected ID signal from different ID signals based on the counted result of the counter.

9 Claims, 6 Drawing Figures

2
4
RF AMP
6
CON
8
LOCAL OSC
10
IF AMP
12
E. DET
14
I. DET
16
Q. DET
18
KAHN CORRECT
20
MOTOROLA CORRECT
22
PHASE SHIFT
24
PHASE SHIFT
26
SELECTOR
Ia
Ib
Ic
Id
Ie
Sa
Sb
L+R
L−R
28
MATRIX
30
L
32
R
34
LIMITER
36
PHASE COMP
38
LOOP FILTER
40
VCO
42
3.6MHz
44
DIV
1/8
450 KHz ∠90°
450 KHz ∠0°
46
FILTER
48
WAVE SHAPING
S2
ID
S3
50
DIV
52
DIV
1/2^13
CL
PLL
54
COUNTER
S4
S1
55Hz
56
DISTINGUISH
58
60
62
64
MG
KN
MT
66
68

LATCH
DIV
MEMO
LEVEL DET
CL
S1
S4
S5
S6
S7
S8
FR-ID
ID

2
RF AMP
4
6
CON
8
OSC
10
IF AMP
12
E. DET
14
I. DET
16
Q. DET
18
KAHN CORRECT
20
MOTOROLA CORRECT
22
PHASE SHIFT
24
PHASE SHIFT
L+R
L+R
L−R
L−R
L−R
26
SELECTOR
Ia
Ib
Ic
Id
Ie
Sa
Sb
L+R
L−R
28
MATRIX
30
L
32
R
34
LIMITER
36
PHASE COMP
38
40
LOOP FILTER
42
VCO
3.6MHz
44
DIV
1/8
450 KHz ∠90°
450 KHz ∠0°
46
FILTER
S2
ID
48
WAVE SHAPING
S3
50
DIV
52
DIV
1/2^13
CL
PLL
54
COUNTER
S4
S1
55Hz
56
DISTINGUISH
58
60
62
64
MG
66
KN
68
MT

AM STEREO RECEIVER

BACKGROUND OF THE INVENTION

1. Field of the invention

The present invention relates to an AM stereo receiver and, more particularly, to a detector for detecting a very low frequency identification (ID) signal in the received broadcasting signal indicating the presence and also the type of AM stereo system being received. The present invention also relates to such an AM stereo receiver which can maintain the received ID signal even when the signal temporarily fluctuates.

2. Description of the Prior Art

At present, three different AM stereo systems are proposed, and are being actually broadcasted in U.S.A. The first system is a quadrature modulation stereo system known as a Motorola AM stereo system. The second system is an independent side-band modulation stereo system which is known as a Kahn AM stereo system, and the third system is a phase modulation system which is known as a Magnavox AM stereo system.

The frequency of the ID signal of Motorola AM stereo system is 25 Hz, that of the Kahn AM stereo system is 15 Hz, and that of the Magnavox AM stereo system is 5 Hz. Since the ID signal is present whenever the stereophonic signals are being broadcasted, the discriminate between the monophonic broadcasting and the stereophonic broadcasting can be accomplished by the detection of the ID signal. Furthermore, by the detection of the frequency of the ID signal, it is possible to detect the type of the stereo system among Motorola, Kahn and Magnavox AM stereo systems.

The detector circuit for detecting the ID signal, particularly the ID signal of Motorola AM stereo system, is disclosed in U.S. Pat. No. 4,405,837 to Ecklund. According to U.S. Pat. No. 4,405,837, the ID signal of Motorola AM stereo system is detected by the use of a band pass filter for filtering the ID signal of 25 Hz. Therefore, to detect three different ID signals, one method is to prepare three different sets of band pass filters for filtering 25 Hz ID signal, 15 Hz ID signal and 5 Hz ID signal, respectively.

However, the use of the band pass filter, or low pass filter, results in the following disadvantages. Since the filter generally contains one or more capacitors, the filter circuit is not appropriate to be assembled in an integrated circuit. Also, since the frequency of the ID signals of Motorola, Kahn and Magnavox AM stereo systems are relatively close to each other, it is necessary to prepare the three different filters that have a very narrow pass band, i.e., a high quality factor. However, when the quality factor is made high, the center frequency of the pass band may be easily shifted by the deviation of the components employed.

SUMMARY OF THE INVENTION

The present invention has been developed with a view to substantially solving the above described disadvantages and has for its essential object to provide an improved AM stereo receiver which is applicable to be assembled in an integrated circuit.

It is also an essential object of the present invention to provide an AM stereo receiver of the above described type which may detect one of the three different ID signals with high accuracy.

It is a further object of the present invention to provide an AM stereo receiver of the above described type which can maintain the detected ID signal even when the broadcasting signal temporarily fluctuates.

In accomplishing these and other objects, an AM stereo receiver according to the present invention comprises an IF circuit for generating an IF signal based on a received signal, a PLL circuit for locking the frequency of the IF signal, a clock circuit for generating a clock signal based on a signal obtained from the PLL circuit, and ID signal detector for detecting any one of the ID signals and for producing a detected ID signal. According to the present invention, the receiver further comprises a circuit for distinguishing which one of the different AM stereo systems does the detected ID signal represent. This circuit includes a pulse generator for generating a first pulse signal having a pulse width as a function of the frequency of the detected ID signal, a counter for counting the number of the clock pulses contained during when the first pulse signal is present, and a distinguish circuit for distinguishing each detected ID signal from different ID signals based on the counted result of the counter.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENTS

Figure 1:
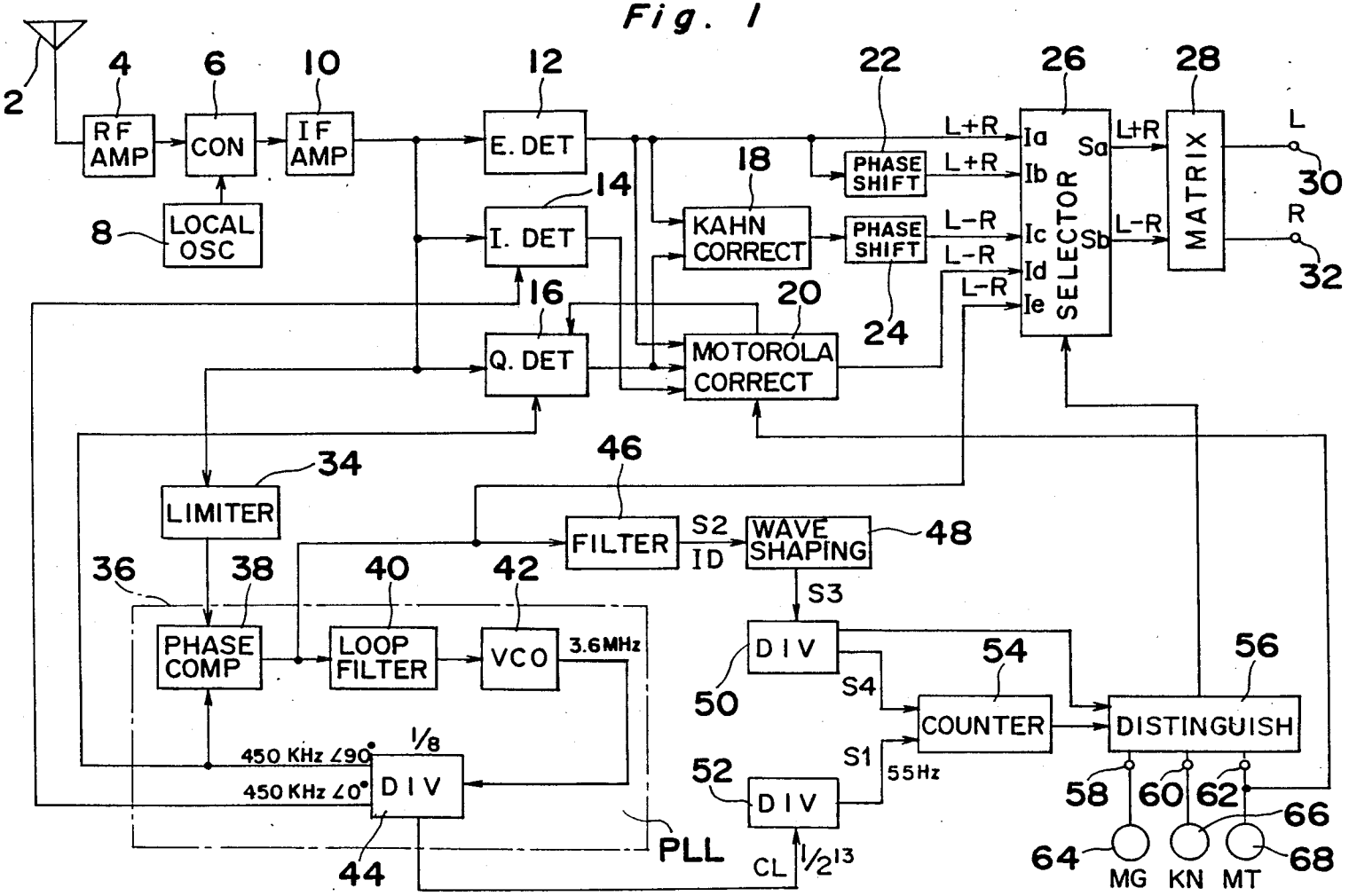
FIG. 1 is a block diagram of an AM receiver according to the present invention.

Referring to FIG. 1, an AM receiver includes an antenna 2, a converter 6, a local oscillator 8 and an intermediate frequency (IF) amplifier 10, which are assembled in a known manner. The IF signal produced from IF amplifier 10 is applied to each of envelope detector 12, inphase detector 14 and quadrature detector 16. The output of envelope detector 12 is connected to a selector 26 directly at input Ia thereof, and also through a phase shift circuit 22 at input Ib thereof. The output of envelope detector 12 is also connected to a Kahn corrector 18 which is in turn connected through a phase shift circuit 24 to selector 26 at input Ic thereof. The output of quadrature detector 16 is connected to Kahn corrector 18 and also to a Motorola corrector 20 which is in turn connected to selector 26 at input Id thereof. Selector 26 also receives at input Ie thereof a signal from a phase comparator 38 which will be described later.

The signals applied to selector 26 are either the sum of the left and right channel signals (L+R signal) or the difference between the left and right channel signals (L−R), as indicated in FIG. 1. One pair of L+R and L−R signals are selected in selector 26 upon receipt of a signal obtained from a distinguish circuit 56, which will be described later. The selected L+R and L−R signals are produced from outputs Sa and Sb of selector 26 and are applied to a matrix circuit 28 which produces the right channel signal and left channel signal separately.

The circuit so far described is known in the art and, therefore, a further description therefor is omitted for the sake of brevity.

Still referring to FIG. 1, the IF signal from IF amplifier 10 is also applied to a limiter 34 which limits the amplitude of the IF signal to a predetermined level. The output of limiter 34 is connected to a phase locked loop PLL. PLL comprises a phase comparator 38, a loop filter 40 and a voltage controlled oscillator 42 which are connected in series. Loop filter 40 may be formed by a band pass filter or a low pass filter. The output of voltage controlled oscillator 42 having the free run frequency at 3.6 MHz is applied to a divided-by-eight frequency divider 44 which reduces the frequency to 450 KHz. Frequency divider 44 produces 450 KHz inphase signal and 450 KHz quadrature signal which has its phase shifted by 90°. The inphase signal is applied to inphase detector 14, and the quadrature signal is applied to quadrature detector 16 and also to phase comparator 38. Either the inphase or the quadrature signal is applied to a divided-by-$2^{13}$ (=8192) frequency divider 52 which reduces the frequency to about 55 Hz. The 55 Hz pulse signal as produced from frequency divider 52 has a waveform S1 shown in FIG. 5.

The IF signal from limiter 34 is a composite signal of 450 KHz signal with a very low frequency signal inserted by way of the phase modulation or quadrature modulation. The very low frequency signal is the ID signal for identifying the difference among Motorola AM stereo system, Kahn AM stereo system and Magnovax AM stereo system. The difference is identified by the frequency such that when the frequency of the ID signal is at 25 Hz, the ID signal represents Motorola AM stereo system. Similarly, when the frequency is at 15 Hz, the ID signal represents Kahn AM stereo system, and when it is at 5 Hz, the ID signal represents Magnovax AM stereo system. Since phase comparator 38 compares the signal from limiter 34 with 450 KHz quadrature signal from frequency divider 44, its output signal contains the ID signal.

Figure 5:
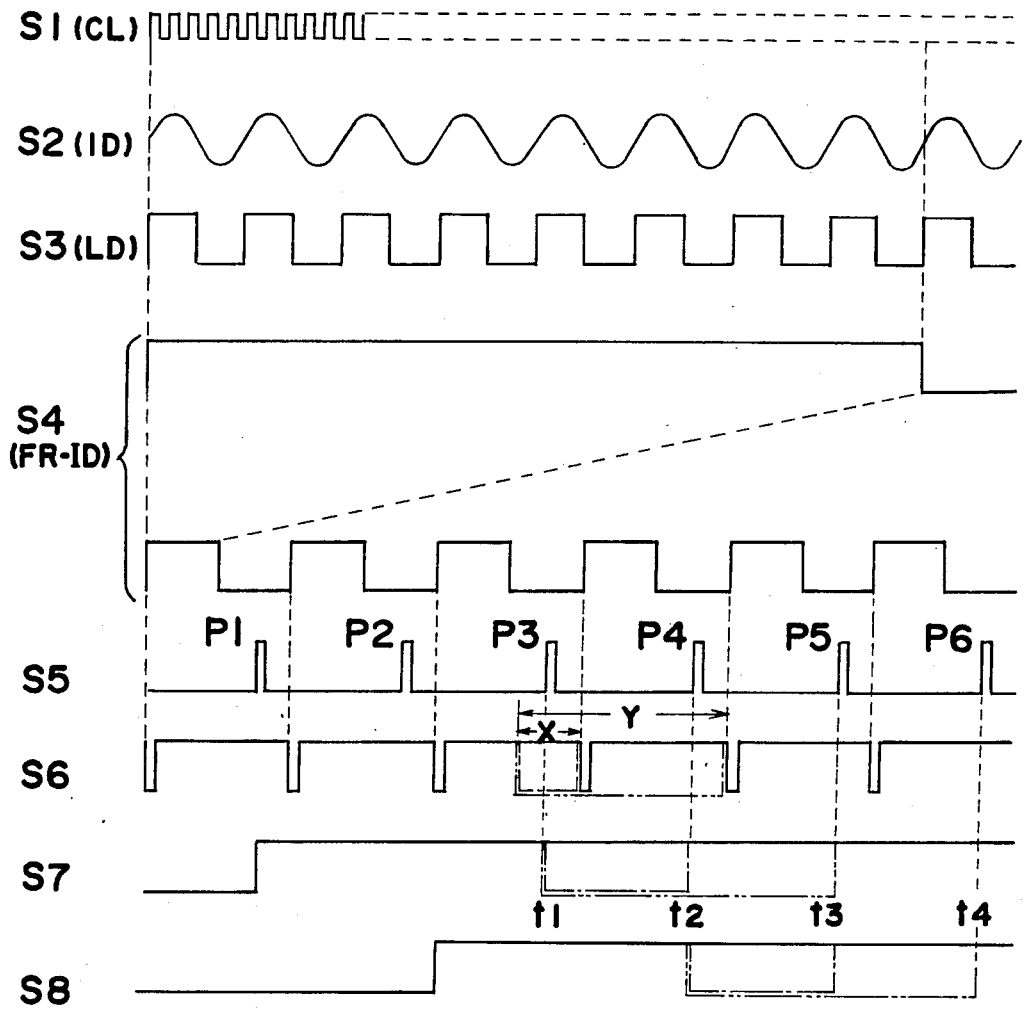
FIG. 5 is a graph showing waveforms obtained at major points in the circuit of FIGS. 1–3.

The output of phase comparator 38 is connected to a filter 46 which is further connected through a wave shaping circuit 48 to a frequency divider 50. Filter 46, which may be formed by a low pass filter or a band pass filter, filters the low frequency component signal in the output signal of phase comparator 38 to produce an ID signal having a low frequency, such as shown by a waveform S2 in FIG. 5. Wave shaping circuit 48 changes the waveform of the ID signal to a retangular pulse wave S3, as shown in FIG. 5. To widen the pulse width of the ID signal, the frequency of the ID signal is reduced in a frequency divider 50, which divides the frequency by a predetermined number, such as by eight. Thus, frequency divider 50 produces a frequency reduced ID signal (referred to as an FR-ID signal or FR-ID pulse) having a relatively wide pulse width, such as shown by a waveform S4. The output signals from frequency dividers 50 and 52 are applied to counter 54 which counts the number of clock pulses (waveform S1) while the FR-ID pulse (waveform S4) is at the HIGH level). The result of the count represents the width of the FR-ID pulse (waveform S4) produced from divider 50, which is in a predetermined relationship with the frequency of the original ID signal. Thus, by detecting the pulse width of the FR-ID signal, it is possible to detect which one of the different stereo system is now being received.

The counted result is applied to a distinguish circuit 56 to detect the type of the stereophonic system now being received. For example, when the counted result is between 16 and 20, distinguish circuit 56 detects that the receiving signal is based on Motorola AM stereo system. Similarly, when the counted result is between 27 and 33, Kahn AM stereo system is detected, and when the counted result is between 80 and 98, Magnavox AM stereo system is detected.

Since the frequency of the ID signal, e.g., for the Kahn AM stereo system, may differ ± a few Hz from 15 Hz, and at the same time, the difference in the frequency between ID signals is 10 Hz, the pulse number that indicates the Kahn AM stereo system does not have to be at a certain point, but can be selected from a range covering pulse numbers between, e.g., 27 and 33. The same can be said to other ID signals. The detail of counter 54 and distinguish circuit 56 will be described below.

Figure 2:
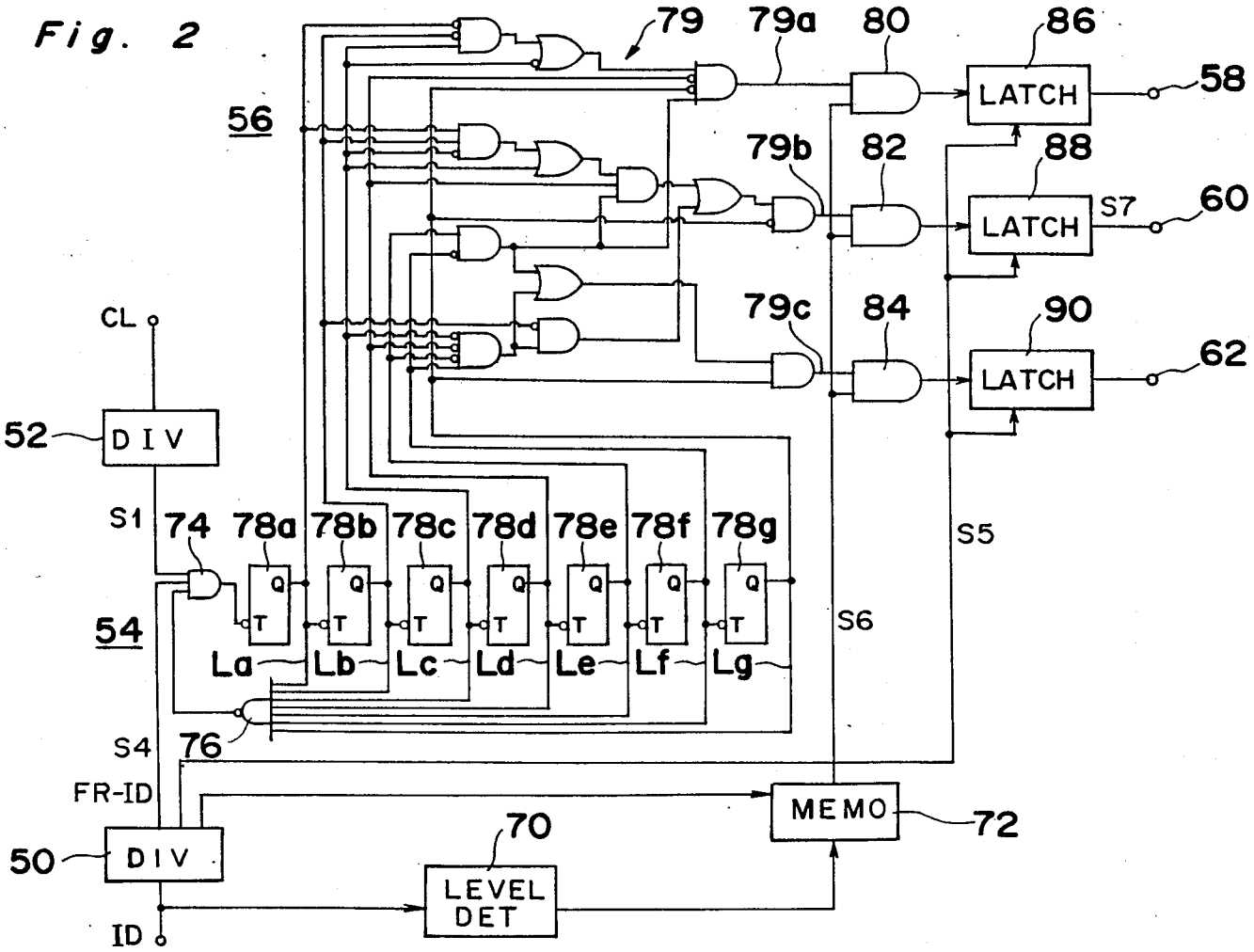
FIG. 2 is a circuit diagram showing the details of the counter and distinguish circuit shown in FIG. 1.

Referring to FIG. 2, counter 54 comprises an AND gate 74, NAND gate 76 and seven T flip flops **78*a*–78*g* connected in cascade. Each T flip flop has a T terminal and a Q terminal. The Q terminals of flip flops 78*a*–78*g* are connected to seven inputs of NAND gate 76** through lines L*a*–L*g*.

Each T flip flop operates such that in response to the trailing edge of a pulse applied to a T terminal, the flip flop is set if it has been in the reset condition, or reset if it has been in the set condition, so that the output from the Q terminal changes from HIGH level to LOW level, or vice versa. For example, assuming that all the flip flops are reset to produce a LOW level signal from its Q terminal, and by the trailing edge of the first clock pulse, flip flop **78*a* is set to produce a HIGH level signal from its Q terminal. Thus, lines La–Lg carry a binary signal of (1000000). Then, by the trailing edge of the second clock pulse, flip flop 78*a* is reset to produce a LOW level signal from its Q terminal, thereby setting the second flip flop 78*b*. Thus, lines La–Lg carry a binary signal of (0100000). Then, by the trailing edge of the third clock pulse, flip flop 78*a* is set. Thus, lines La–Lg carry a binary signal of (1100000). Then, by the trailing edge of the fourth clock pulse, flip flops 78*a* and 78*b* are reset, and flip flop 78*c*** is set. Thus, lines La–Lg carry a binary signal of (0010000). In this manner, the number of the pulses can be counted up to $2^7$.

NAND gate 76 produces a LOW level signal only when all the Q terminals produce a HIGH level signal, that is when the counter has counted up to the maximum value $2^7$. Other than that, NAND gate 76 produces a HIGH level signal. AND gate 74 is enabled to permit clock pulses (waveform S1) to pass therethrough when both NAND gate 76 and frequency divider 50 are producing a HIGH level signal. However, since the signal from NAND gate 76 is normally at the HIGH level, AND gate 74 is substantially gated by the FR-ID pulse (waveform S4) produced from frequency divider 50.

Still referring to FIG. 2, distinguish circuit 56 comprises a logic circuit 79 connected to lines La–Lg, AND gates 80, 82 and 84, and latches 86, 88 and 90. Logic circuit 79 is defined by a number of logic gates which are connected in a sophisticated manner, such as shown in FIG. 2, which is merely an example. Logic circuit 79 has three outputs 79a, 79b and 79c. Output 79a produces a HIGH level signal when the amount counted by counter 54 is between 16 and 20. Output 79b produces a HIGH level signal when the counted amount is between 27 and 33, and ouput 79c produces a HIGH level signal when the counted amount is between 80 Iand 98. These numbers are given merely as an example, and therefore, they can be changed to any desired number by changing the design of the logic circuit.

AND gates 80, 82 and 84 receive signals from outputs 79a, 79b and 79c, respectively, and at the same time, receive a level signal (waveform S6) from a memory 72. Memory 72 receives data from a level detector 70 which is connected to a line carrying the ID signal or FR-ID signal, such as a line between wave shaping circuit 48 and frequency divider 50. Also, as apparent from waveforms S4 and S6 shown in FIG. 5, memory 72 is reset and carries a new data in response to the leading edge of the FR-ID signal (waveform S4) applied to AND gate 74. Memory 72 operates in such a manner that, when the reset signal is applied, it produces a HIGH level signal upon detection of a HIGH level signal from level detector 70. But, it level detector 70 temporarily produces, before the next reset signal is produced, a LOW level signal because the broadcasting signal is weakended or for some other reason, the output of memory 72 immediately changes its output to a LOW level signal and stores the LOW level signal until a next reset signal is provided.

The outputs of AND gates 80, 82 and 84 are connected to latches 86, 88 and 90, respectively. Latches 86, 88 and 90 are enabled by a latch pulse (waveform S5) produced from frequency divider 50 at a pulse interval of the FR-ID pulses (waveform S4), as illustrated in FIG. 5. The outputs of latches 86, 88 and 90 correspond to the outputs of distinguish circuit 56.

The operation of distinguish circuit 56 is as follows. It is assumed that the FR-ID signal (waveform S4) now has a pulse width corresponding to thirty clock pulses (waveform S1). In this case, while counter 54 is counting up the clock pulse from 16 to 20, output 79a produces a HIGH level signal and other outputs 79b and 79c are maintained at a LOW level signal. The HIGH level signal from output 79a will not be latched in latch 86 because the latch pulse (waveform S5) is not yet provided. Thereafter, output 79b produces a HIGH level signal while counter 54 is counting up the clock pulses from 27 to 30, and other outputs 79a and 79c are maintained at a LOW level signal. When counter 54 has counted thirty clock pulses, a further count up operation stops, because the FR-ID signal changes its state from HIGH to LOW. Thereafter and before the FR-ID signal changes its state back to HIGH again, a latch pulse P1 (waveform S5) is produced, thereby storing the HIGH level signal from output 79b in latch 88, and at the same time, storing the LOW level signal from outputs 79a and 79c in latches 86 and 90, respectively. Thus, output 60 produces a HIGH level signal (waveform S7) after the latch pulse P1, whereas other outputs 58 and 62 are maintained at LOW level signal. As long as the same FR-ID signal is present, the signals from outputs 58, 60 and 62 are maintained in the same condition.

Figures 3, 4:
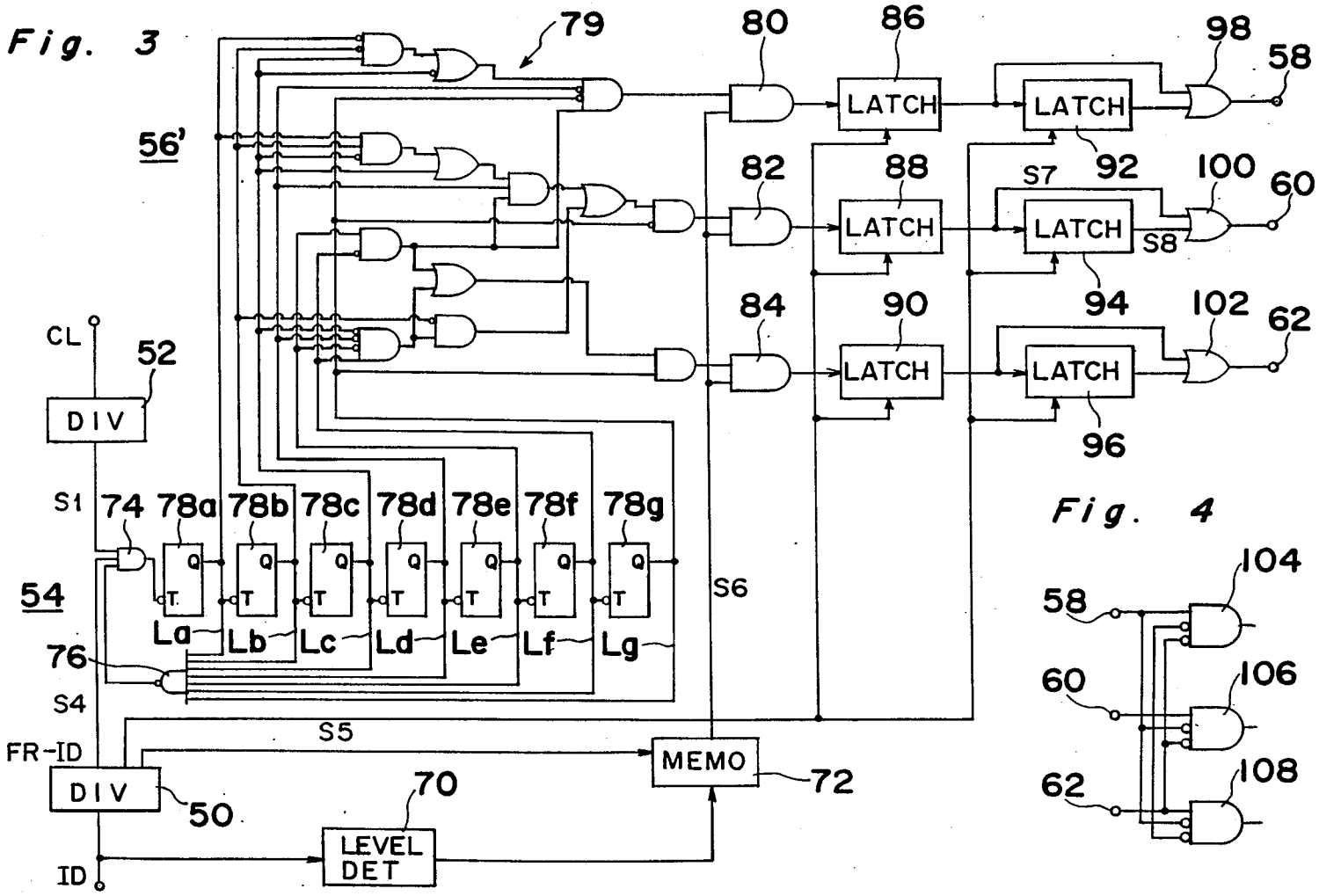
FIG. 3 is a circuit diagram showing a modification of the circuit of FIG. 2.
FIG. 4 is a circuit diagram which may be further added to the circuit of FIG. 2 or 3.

Referring to FIG. 3, a modification 56' of the distinguish circuit is shown. When compared with distinguish circuit 56 of FIG. 2, distinguish circuit 56' further has additional latches 92, 94 and 96 and OR gates 98, 100 and 102. Latches 92, 94 and 96, which are referred to as second stage latches, are connected respectively to the outputs of latches 86, 88 and 90, which are referred to as first stage latches. Preferably, latches 86, 88, 90, 92, 94 and 96 are formed by shift registers. OR gate 98 is connected to both outputs of latches 86 and 92. Similarly, OR gate 100 is connected to both outputs of latches 88 and 94, and OR gate 102 is connected to both otuputs of latches 90 and 96. As apparent from the description below, the second stage latches 92, 94 and 96 serve as a one cycle delay circuit. Here, one cycle means one cycle of FR-ID signal.

The latches operate such that, by the first latch pulse P1, the signals produced from AND gates 80, 82 and 84 are stored in the first stage latches 86, 88 and 90, respectively, and at the same time, the signals produced from the first stage latches 86, 88 and 90 are shifted to the second stage latches 92, 94 and 96, respectively. Thus, in the above described case, the HIGH level signal produced from AND gate 82 is stored in latch 88 in response to the first latch pulse P1, and the HIGH level signal produced from latch 88 is shifted to latch 94 in response to the second latch pulse P2. Also, in response to the second latch pulse P2, latch 88 stores the HIGH level signal from AND gate 82. Accordingly, latch 88 continues to produce a HIGH level signal (waveform S7) after the first latch pulse P1, and latch 94 continues to produce a HIGH level signal (waveform S8) after the second latch pulse P2. These two outputs are ORed and produced from output 60. The modification of FIG. 3 has the following advantage.

When the ID signal temporarily disappears or flucutates due the poor receiving condition, or by any other reason, memory 72 will immediately produce a LOW level signal, which is maintained at least until the generation of a next reset signal.

For example, first it is assumed that memory 72 produces a LOW level signal at a time period X as indicated by a signal-dot chain line shown in waveform S6 in FIG. 5. In this case, AND gates 80, 82 and 84 are disabled during period X to prevent the transmission of any HIGH level signal through AND gates 80, 82 and 84. Thus, in spite of the HIGH level signal applied from logic circuit 79 to AND gate 82, AND gate 82, as well as other AND gates 80 and 84, produces a LOW level signal during period X. Thus, in response to a latch pulse P3 (waveform S5), latch 88, which has been carrying a HIGH level signal, receives and stores a LOW level signal, as indicated by a single-dot chain line in waveform S7. Also, in response to the latch pulse P3, latch 94, which has been carrying a HIGH level signal, receives and stores a HIGH level signal from latch 88. Then, when a next latch pulse P4 is produced, latch 88 stores a HIGH level signal as shifted from AND gate 82, and latch 94 stores a LOW level signal (single-dot chain line in waveform S8) as shifted from latch 88. Then, when a further next latch pulse P5 is produced, both latches 88 and 94 stores a HIGH level signal. Thus, at a period between times t1 and t2 shown in FIG. 5, OR gate 100 receives the LOW level signal S7 from latch 88 and the HIGH level signal S8 from latch 94, thereby producing a HIGH level signal therefrom. Similarly, at a period between times t2 and t3, OR gate 100 produces a HIGH level signal. Thus, the temporary fluctuation in the ID signal or in the level signal (waveform S6) produced from memory 72 will not influence the output of distinguish circuit 56'. Thus, the user of the stereophonic receiver will hear the audio maintained in the stereophonic position.

Next, it is assumed that the level signal produces a LOW level signal at a time period Y as indicated by a double-dot chain line shown in waveform S6 in FIG. 5, which is longer than the time period X. In this case, latch 88 stores a LOW level signal (double-dot chain line in waveform S7) during a period between times t1 and t3, and latch 94 stores a LOW level signal (double-dot chain line in waveform S8) during a period between times t2 and t4. Accordingly, OR gate 60 produces a LOW level signal in a period between times t2 and t3, in which the user of the stereophonic receiver will hear the audio move temporarily from the stereophonic position to the monophonic position.

As apparent from the above, a LOW level signal produced temporarily from memory 72 for a period of time not longer than one cycle length of the FR-ID signal (waveform S4) will not result in the interruption of the audio in the stereophonic position.

According to a preferred embodiment, AND gates 104, 106 and 108 are connected to outputs 58, 60 and 62, in a manner shown in FIG. 4. the output signal can be produced only when one of three outputs 58, 60 and 62 has a HIGH level signal. If two or three of the three outputs carry a HIGH level signal, all the AND gates are disabled so that none of the HIGH level signal can be produced.

Referring back to FIG. 1, the signals produced from outputs 58, 60 and 62 are used to control indicator lamps 64, 66 and 68 representing Magnavox, Kahn and Motorola AM stereo system, respectively, and also to control the AM receiver in a manner described below.

When the received AM stereo signal is based on the Motorola AM stereo system, a HIGH level signal from output 62 of distinguish circuit 56 turns indicator lamp 68 on and, at the same time, actuates Motorola corrector 20. Also, distinguish circuit 56 provides a signal to selector 26 to select input Ia and input Id. The L+R and L−R signals at the selected inputs are applied to matrix circuit 28 to separate the L channel signal and the R channel signal.

When the received AM stereo signal is based on the Kahn AM stereo system, a LOW level signal from output 62 deactuates Motorola corrector 20, and a HIGH level signal from output 60 turns indicator lamp 66 on. Also, distinguish circuit 56 provides a signal to selector 26 to select input Ib and input Ic. Then, the L and R channel signals are separated in the same manner.

When the received AM stereo signal is based on the Magnavox AM stereo system, a LOW level signal from output 62 deactuates Motorola corrector 20, and a HIGH level signal from output 58 turns indicator lamp 64 on. Also, distinguish circuit 56 provides a signal to selector 26 to select input Ia and input Ie. Then, the L and R channel signals are separated in the same manner.

Figure 6:
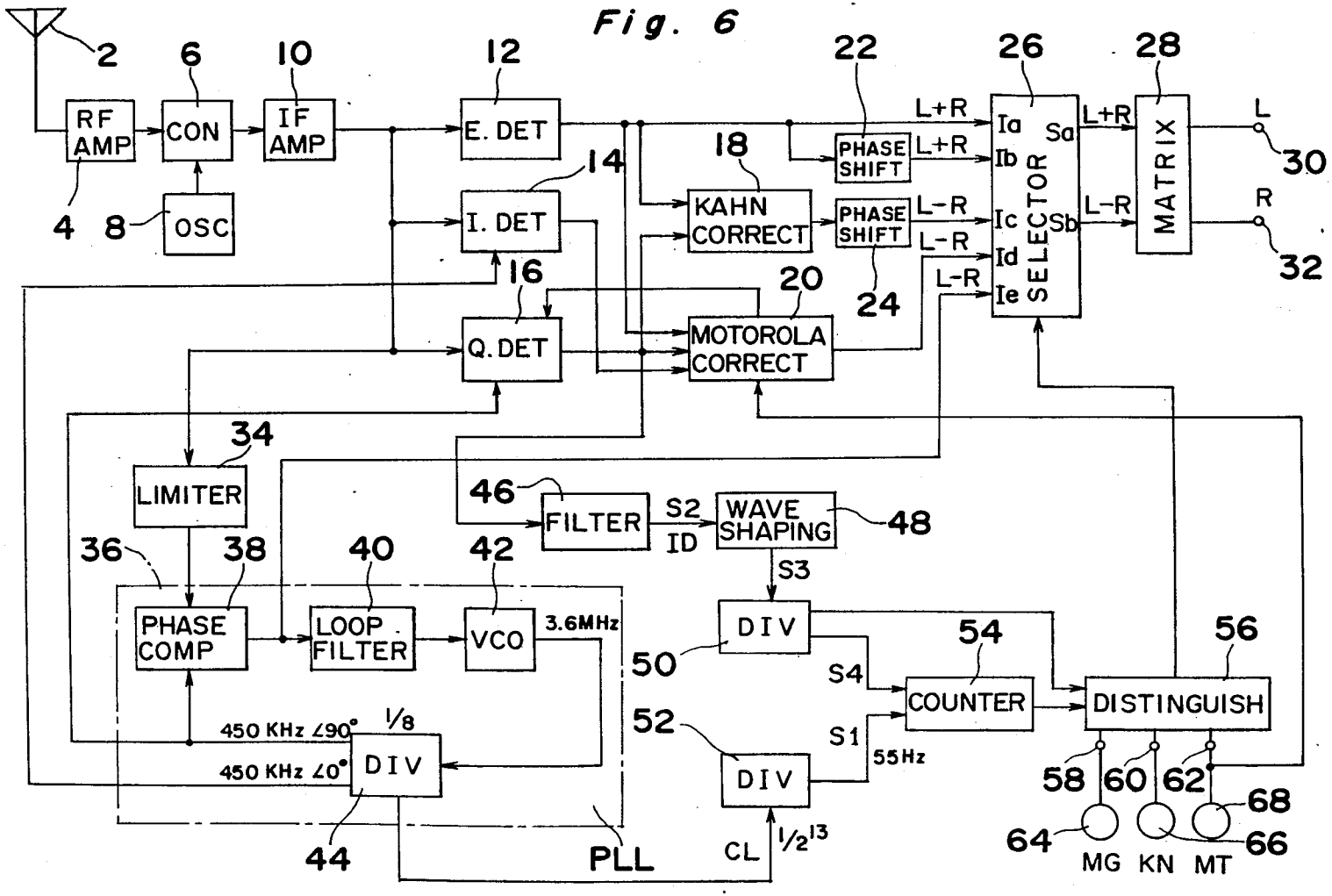
FIG. 6 is a block diagram showing a modification of the block diagram of FIG. 1.

It is to be noted that the source for receiving the ID signal to filter 46 is not limited to phase comparator 38, such as shown in FIG. 1. It is possible to connect the input of filter 46 to some other part in the AM receiver where the ID signal is available. For example, as shown in FIG. 6, the input of filter 46 may be connected to quadrature detector 16.

According to the AM stereo receiver of the present invention, the different systems of the AM stereo broadcasting can be detected automatically, and the AM receiver can be automatically set in a condition appropriate to receive the AM stereo signal of the detected system.

According to the present invention, since the three different frequency ID signals are detected by the use of one filter 46, the AM receiver of the present invention is applicable to be assembled in an integrated circuit.

Since the ID signal is detected by counting the number of pulses generated by the use of IF signal having a stable frequency, it is not necessary to provide an oscillator separately.

Also, since the output of distinguish circuit 56 is being ORed between the newly detected data as stored in the first stage latches and the data detected in the previous cycle as stored in the second stage latches, the intrusion of LOW level signals while receiving a HIGH level signal can be effectively eliminated. Thus, the user of the stereophonic receiver will hear the audio maintained in the stereophonic position, even when the AM stereo signal temporarily fluctuates, or when noise signals are present.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. An AM stereo receiver for receiving AM stereo signals containing ID signals which represent different AM stereo systems, said AM stereo receiver comprising:

an IF circuit for generating an IF signal based on a received signal;

a PLL circuit for locking onto the frequency of said IF signal;

a clock circuit for generating a clock signal based on a signal obtained from said PLL circuit;

ID signal detector means responsive to a signal from said PLL circuit for detecting any one of said ID signals and for producing a detected ID signal;

pulse generator means for generating a first pulse signal having a pulse width corresponding to a plurality of cycles of the detected ID signal;

counter means for counting the number of said clock pulses occurring during when said first pulse signal is present; and distinguishing means for distinguishing each detected ID signal from a number of different ID signals based on the counted result of said counter means, thereby making it possible to distinguish one ID signal from a number of different ID signals with the use of a single circuit path.

2. An AM stereo receiver as claimed in claim 1, wherein said ID signal detector means comprises a quadrature detector which receives said IF signal.

3. An AM stereo receiver as claimed in claim 1 wherein said ID signal detector means comprises said phase comparator.

4. An AM stereo receiver for receiving AM stereo signals containing ID signals which represent different AM stereo systems, said AM stereo receiver comprising:

an IF circuit for generating an IF signal based on a received signal;

a PLL circuit for locking onto the frequency of said IF signal;

a clock circuit for generating a clock signal based on a signal obtained from said PLL circuit;

ID signal detector means responsive to a signal from said PLL circuit for detecting any one of said ID signals and for producing a detected ID signal;

pulse generator means for generating a first pulse signal having a pulse width corresponding to a plurality of cycles of the detected ID signal;

counter means for counting the number of said clock pulses occurring during when said first pulse signal is present; and distinguishing means for distinguishing each detected ID signal from a number of different ID signals based on the counted result of said counter means, thereby making it possible to distinguish one ID signal from a number of different ID signals with the use of a single circuit path, wherein said counter means comprises an AND gate for receiving said clock pulses and said first pulse signal and a plurality of flip flops connected to an output of said AND gate in cascade, said flip flops producing a signal representing the counted number of said clock pulses, wherein said distinguishing means comprises a logic circuit which receives output signals from said flip flops to detect one of a plurality of ranges in which the counted number of said clock pulses falls, wherein said distinguishing means further comprises first latch means for storing the output signal of said logic circuit after the presence of each first pulse signal and wherein said distinguishing means further comprises second latch means connected to said first latch means for storing the output signal of said first latch means, and OR gate means for taking a logic OR between the output signals of said first and second latch means.

5. An AM stereo receiver applicable to receive AM stereo signals containing ID signals which represent different AM stereo systems, said AM stereo receiver comprising:

ID signal detector means for detecting any one of said ID signals and for producing a detected ID signal;

distinguishing means for distinguishing each detected ID signal from a number of different ID signals and for producing an indication signal along a plurality of channels representing different AM stereo system;

first latch means connected to said distinguishing means through said plurality of channels for storing the distinguished result;

second latch means connected to said first latch means through said plurality of channels for storing the output of said first latch means such that said first latch means stores the present distinguished result and said second latch means stores the previous distinguished result;

logic gate means connected to said first and second latch means through said plurality of channels for producing said indication signal when said indication signal is present at least in one of said first and second latch means.

6. An AM stereo receiver as claimed in claim 5, wherein said first latch means comprises a plurality of shift registers inserted in said plurality of channels, respectively.

7. An AM stereo receiver as claimed in claim 6, wherein said second latch means comprises a plurality of shift registers inserted in said plurality of channels, respectively.

8. An AM stereo receiver as claimed in claim 7, wherein said logic gate means comprises a plurality of OR gates inserted in said plurality of channels, respectively, so as to receive an output of said shift register in said first latch means and an output of said shift register in said second latch means.

9. An AM stereo receiver as claimed in claim 8, wherein outputs of said plurality of OR gates are connected to a cutting means to cut off the output from said OR gates when more than one channel carries said indication signal.

* * * * *

UNITED STATES PATENT AND TRADEMARK OFFICE

CERTIFICATE OF CORRECTION

PATENT NO. : 4,707,856

DATED : November 17, 1987

INVENTOR(S) : Tanaka et al.

It is certified that error appears in the above-identified patent and that said Letters Patent is hereby corrected as shown below:

In Section [73] Assignees:

The assignee should read: --Sanyo Electric Co., Ltd., Osaka-Fu;

Signed and Sealed this

Sixth Day of June, 1989

*Attest:*

DONALD J. QUIGG

*Attesting Officer*

*Commissioner of Patents and Trademarks*